United States Patent [19]

Katoh

[11] Patent Number: 4,629,677

[45] Date of Patent: Dec. 16, 1986

[54] ELEMENT FOR DIFFUSION TRANSFER WITH STRIPPING LAYER OF CROSSLINKED POLYMER FROM ETHENICALLY UNSATURATED CARBOXYLIC ACID OR SALT THEREOF

[75] Inventor: Kazunobu Katoh, Kanagawa, Japan

[73] Assignee: Fuji Photo Film Co., Ltd., Kanagawa, Japan

[21] Appl. No.: 744,342

[22] Filed: Jun. 13, 1985

[30] Foreign Application Priority Data

Jun. 14, 1984 [JP] Japan ..... 59-122759

[51] Int. Cl.[4] ..... G03C 1/40; G03C 5/54; G03C 1/90

[52] U.S. Cl. ..... 430/215; 430/227; 430/263

[58] Field of Search ..... 430/215, 216, 227, 263

[56] References Cited

U.S. PATENT DOCUMENTS

| | | | |
|---|---|---|---|
| 2,759,825 | 8/1956 | Land | 430/263 |
| 3,730,718 | 5/1973 | Danhauser | 430/259 |
| 3,820,999 | 6/1974 | Tsuji et al. | 430/262 |
| 4,009,031 | 2/1977 | Carlson et al. | 430/215 |
| 4,190,448 | 2/1980 | Sera et al. | 430/216 |
| 4,284,708 | 8/1981 | Helling et al. | 430/216 |
| 4,355,091 | 10/1982 | MacLeish et al. | 430/216 |

*Primary Examiner*—Richard L. Schilling

*Attorney, Agent, or Firm*—Sughrue, Mion, Zinn, Macpeak, and Seas

[57] ABSTRACT

An image-receiving element for a diffusion transfer photographic process is described, comprising a support having thereon an image-receiving layer and a stripping layer composed of a copolymer, wherein said copolymer contains more than 40 mole % of a monomer unit derived from an ethylenically unsaturated carboxylic acid or a salt thereof, and said stripping layer is at least partially crosslinked.

21 Claims, No Drawings

ELEMENT FOR DIFFUSION TRANSFER WITH STRIPPING LAYER OF CROSSLINKED POLYMER FROM ETHENICALLY UNSATURATED CARBOXYLIC ACID OR SALT THEREOF

FIELD OF THE INVENTION

This invention relates to a silver salt diffusion transfer process and a color diffusion transfer process. More particularly, the invention relates to an image-receiving element for so-called peel apart type diffusion transfer process.

BACKGROUND OF THE INVENTION

An image-receiving element and a light-sensitive element for forming transfer images by a silver salt diffusion process or a color diffusion transfer process, as well as a chemical reaction mechanism for image formation, are well known in the art.

In particular, an image-receiving element for a peel apart type diffusion transfer process is most generally used as a photographic film unit united with a light-sensitive sheet, that is, for a film unit composed of a light-sensitive sheet having on a support at least one light-sensitive silver halide emulsion layer, an image-receiving sheet having on another support at least an image-receiving layer, and between the sheets a pressure rupturable container containing a processing solution. In the film unit, after imagewise exposing the silver halide emulsion layer(s), the film unit is passed through a pair of juxtaposed pressure-applying rollers to rupture the container and to spread the processing solution between the sheets, whereby the development thereof is performed. As the result of the development, image-forming material(s) are imagewise diffused from the emulsion layer(s) or the dye-providing compound-(hereinafter referred to as a coloring material)-containing layer(s) associated therewith into an image-receiving layer formed on another support and fixed therein, to form, thereby, a transferred image. For obtaining desired positive prints or slide, the image-receiving sheet is separated from the light-sensitive sheet but in this case, if the separation of the image-receiving sheet is not performed smoothly or the processing solution remains on the image-receiving sheet, the images formed on the image-receiving sheet are stained, thus greatly reducing the image quality.

For easily separating the image-receiving sheet from the light-sensitive sheet and for preventing a processing solution from remaining on the image-receiving layer, it is known to form a layer referred to as a "stripping layer" on the image-receiving layer (at the processing solution spreading side).

Examples of materials for this kind of stripping layer are usually water-soluble or hydrophilic polymers such as gum arabic (U.S. Pat. Nos. 2,759,825; 4,009,031, etc.,); hydroxyethyl cellulose (U.S. Pat. No. 2,759,825 and Japanese Patent Application (OPI) No. 8237/72; the term "OPI" indicates an unexamined published patent application open to public inspection); methyl cellulose, ethyl cellulose, and nitrocellulose (U.S. Pat. No. 2,759,825); cellulose acetate hydrogen naphthalate (Canadian Pat. No. 681,777 and Japanese Patent Application (OPI) No. 41,623/72); carboxymethyl cellulose (U.K. Pat. No. 2,012,064); cellulose derivatives (Japanese Patent Publication No. 24,075/70; starch ethers (Japanese Patent Publication No. 35,820/75); galactomannan (U.K. Pat. No. 869,190); pectin (U.S. Pat. No. 2,759,825); phthalated gelatin (Japanese Patent Publication No. 24,075/70 and Japanese Patent Application (OPI) Nos. 74,431,79; 126,535/79); sodium alginate (U.S. Pat. No. 2,759,825); polyvinyl alcohol (U.S. Pat. No. 2,759,825 and U.K. Pat. No. 2,012,064, and Japanese Patent Publication No. 24,075/70); polymethacrylic acid (U.S. Pat. No. 2,759,825); etc. However, these materials have drawbacks in that the physical development center in the image-receiving layer (1) is denatured owing to the hygroscopicity of the material to change the density and color tone of the transferred images; (2) since natural materials are frequently used as the stripping layer materials described above, they sometimes deteriorate or get musty when they are stored as raw materials, i.e., they are unstable with the passage of time in having a tendency to be denatured; and (3) since water is used as a coating solvent for the materials, the energy required for drying is large and it takes a long period of time to dry the coated layer of the material; etc.

Furthermore, the use of the above-described materials is frequently accompanied by the problem that the transferred silver images show metallic luster, and the transferred density becomes low due to hindrance in the transfer.

For overcoming these problems, it has been proposed to use water-insoluble synthetic polymers such as a vinyl acetate-maleic anhydride copolymer and a methyl methacrylate-acrylic acid copolymer (described in Japanese Patent Publication No. 15,902/70); a barbituric acid-formalin condensation product (described in Japanese Patent Publication No. 4333/74); graft copolymers of gelatin sufficiently reacted with a dicarboxylic anhydride such as phthalic anhydride, etc., and a monomer such as a vinyl ester, vinyl ether, acrylic acid ester, etc., or a mixture thereof (described in Japanese Patent Application (OPI) No. 65,133/81), etc., as the materials for the stripping layers. However, it has now been clarified as a result of our detailed investigations that the use of the polymers described in the above-described patents for the stripping layers is accompanied by the following demerits. That is, these polymers have a poor film-forming property and are resistant to forming a thin uniform coating. As a result thereof, the images obtained by development in the image-receiving sheet using the polymer for the stripping layer are poor in uniformity and form undesirable image unevenness, which greatly reduces the commercial value of the photographic materials.

Also, as another method for overcoming the aforesaid difficulties, it has been proposed to use a stripping layer composed of a ternary polymer of styrene, acrylic acid (or methacrylic acid), and methyl acrylate (or methyl methacrylate) dispersed in a water-soluble polymer such as hydroxyethyl cellulose as described in U.S. Pat. No. 4,366,227. However, when photographic material having the image-receiving layer using the polymer for the stripping layer regardless of the water-soluble polymer or water-insoluble polymer is developed at temperatures lower than normal room temperature (about 20° C), the component of the processing solution attached to the image-forming sheet causes so-called "clouding", i.e., is crystallized by drying to form white turbidity of images on the image surfaces.

Moreover, when the photographic material having the image-receiving sheet using the polymer for the stripping layer is developed at temperatures higher than normal room temperature, the processing solution partially remains on the surface of the image-receiving sheet.

SUMMARY OF THE INVENTION

An object of this invention is to provide an image-receiving element for diffusion transfer process having a stripping layer which has a good film-forming property, can be coated in a thin layer with good uniformity, and shows a good stripping property over a wide range of processing time and processing temperature (i.e., stripping time).

As a result of extensive investigations, the inventors have discovered that the above-described object can be effectively attained by an image-receiving element for a diffusion transfer photographic process comprising a support having thereon an image-receiving layer and a stripping layer composed of a copolymer, wherein said copolymer contains more than 40 mole % of a monomer unit derived from an ethylenically unsaturated carboxylic acid or a salt thereof, and said stripping layer is at least partially crosslinked.

DESCRIPTION OF THE PREFERRED EMBODIMENT

It is known to use a copolymer itself having a carboxylic acid or a carboxylate as a polymer for a neutralization layer of a diffusion transfer photographic material, and the layer composed of the copolymer is disposed between a support and an image-receiving layer and at the farthest position from the position from which a processing solution is spread during development. On the other hand, in this invention, the copolymer is applied for a stripping layer which is disposed at the position at which a processing solution is spread and is partially crosslinked, whereby the following unexpected effects can be obtained.

That is, the polymer for the stripping layer in this invention forms a uniform and good coating even in the case of a thin layer coating. The coating shows a good adhesive property with an adjacent layer (e.g., an image-receiving layer) in a dry state before processing. Also, the polymer for use in this invention has a hydrophilic property and alkali swelling property, and thus since the stripping layer composed of the polymer is swelled and softened when an alkaline processing solution is spread thereover during development and the image-forming materials, etc., carried by the processing solution or diffused in the processing solution can be freely passed through the layer, the presence of the polymer layer does not result in any problem for the formation of images. The polymer layer also shows a good stripping property over a wide range of processing time and processing temperature at stripping the image-receiving sheet from the light-sensitive sheet after image formation (i.e., stabilization), and there are no problems such as so-called "formation of powder-coating", "clouding", image uneveness, reduction in density, change in color tone, etc., caused by the remaining processing solution on the image surface, which frequently occurs in conventional techniques.

Also, the stripping layer according to this invention does not show deterioration in the stripping performance when the image-receiving element is subjected to a forced aging test, and shows unexpectedly excellent stability in storage over long periods of time.

It is also one of the features of this invention that since the stripping layer in this invention can be coated by using an organic solvent such as an alcohol, etc., the energy required for drying at the formation of the stripping layer is low.

The stripping layer in this invention may contain other materials, if such do not reduce the effect of this invention, such as, for example, a color toning agent, an image stabilizer, an antistatic agent, an optical whitening agent, an antifoggant, etc.

If the thickness of the stripping layer in this invention is too thick, "clouding" is liable to occur in development at a low temperature, while if the thickness is too thin, problems caused by attachment of the processing solution in a development of a long period of time are likely found. Accordingly, it is generally appropriate proper that the thickness of the stripping layer is from about 0.001 $g/m^2$ to 1.0 $g/m^2$, and preferably it is from 0.01 $g/m^2$ to 0.5 $g/m^2$.

The above-described coating amount or thickness is also important in the point of substantially reducing the alkaline property of the processing solution. Therefore, the stripping layer for use in this invention is clearly distinguished from the type of neutralization layers (a layer for neutralizing a high pH of a processing solution to a neutral range) that have been most frequently used in a diffusion transfer process.

A preferred example of the copolymer which is used for stripping layers in this invention can be represented by formula (I)

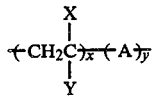

(I)

wherein X represents a hydrogen atom, a halogen atom, a cyano group, or an unsubstituted or substituted alkyl group; Y represents a hydrogen atom, a halogen atom, a cyano group, an unsubstituted or substituted alkyl group, a group represented by

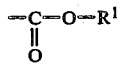

(wherein $R^1$ represents an unsubstituted or substituted alkyl group having 2 or more carbon atoms or an unsubstituted or substituted aryl group), a group represented by

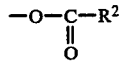

(wherein $R^2$ represents an unsubstituted or substituted alkyl group or an unsubstituted or substituted aryl group), a group represented by

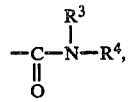

or a group represented by

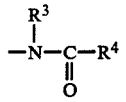

(wherein $R^3$ and $R^4$ (which it is to be understood may be the same or different) each represents a hydrogen atom, an unsubstituted or substituted alkyl group, or an unsubstituted or substituted aryl group); A represents a monomer unit derived from an ethylenically unsaturated monocarboxylic acid which is copolymerizable with an ethylenically unsaturated monomer; or a salt of the monocarboxylic acid; and x and y are mol or percentages of the repeating units of the copolymer and have the relationship;

$$x+y=100,$$

$$0<x<60,$$

and $$40\leqq y<100.$$

Substituents for the above-described substituted alkyl group and substituted aryl group include a hydroxy group, a halogen atom (preferably a chlorine atom), a cyano group, an alkyl group, an aryl group, etc.

Of the copolymers represented by the above-described formula (I), the following copolymers are preferred. That is, in formula (I), it is preferred that X is a hydrogen atom or an unsubstituted or substituted alkyl group, said alkyl residue having from 1 to 4 carbon atoms; Y is a group represented by

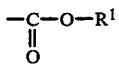

(wherein $R^1$ is an unsubstituted or substituted alkyl group, said alkyl residue having from 2 to 12 carbon atoms), a group represented by

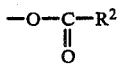

(wherein $R^2$ is an unsubstituted or substituted alkyl group, said alkyl residue having from 1 to 12 carbon atoms, or a group represented by

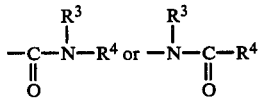

(wherein, $R^3$ and $R^4$ (which it is to be understood may be the same or different) each represents a hydrogen atom or an unsubstituted or substituted alkyl group, said alkyl residue having from 1 to 12 carbon atoms.

With respect to the mol or percentages of the monomer components, y is preferably from 60 to 99, and more preferably from 70 to 90.

Y in the above formula (I) is more preferably a group represented by

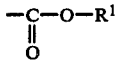

(wherein $R^1$ is an unsubstituted or substituted alkyl group, said alkyl residue having 2 to 6 carbon atoms, more preferably 3 to 5 carbon atoms), or a group represented by

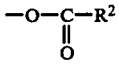

(wherein $R^2$ represents an unsubstituted or substituted alkyl group, said alkyl residue having 1 to 6 carbon atoms).

The monomer preferably providing component A is represented by following formula (II)

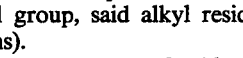

$$CH_2{=}CH{-}COOR^5 \qquad \text{(II)}$$

wherein $R^5$ represents a hydrogen atom, a group represented by

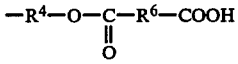

or a group shown by

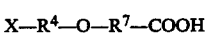

(wherein $R^4$ and $R^6$ (which it is to be understood may be same or different) each represents an unsubstituted or substituted alkylene group (preferably having 2 to 4 carbon atoms, more preferably an ethylene group) and $R^7$ represents an unsubstituted or substituted alkylene group as described above or an unsubstituted or substituted arylene group (preferably, a phenylene group)).

The monomer represented by formula (II) described above may be used as a form of the salt thereof and as a cation for forming the salt, there are an alkali metal ion, an alkaline earth metal ion, and an ammonium ion.

Specific examples of the monomer represented by formula (II) are illustrated below (in the forms of the free acid).

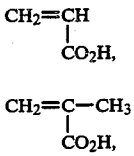

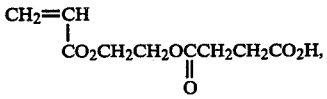

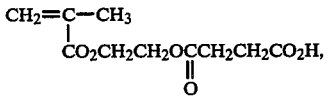

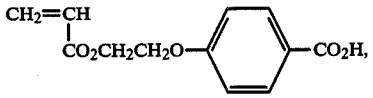

-continued

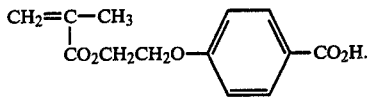

Of the above-described monomers, the use of acrylic acid or methacrylic acid is particularly preferred.

The copolymer by above-described formula (I) may further contain other copolymerizable monomer component (e.g., a repeating unit derived from styrenes, such as, specifically, styrene, α-methylstyrene, 4-methylstyrene, etc.).

Specific examples of the copolymer represented by formula (I) described above are illustrated below (the copolymerization ratios in the illustrated compounds are set forth by molar percentages) although the copolymers for use in this invention are not limited to these compounds. Tg indicates the glass transition temperature.

| | | Tg |
|---|---|---|
| 1. | 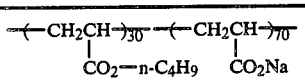 | 66.9° C. |
| 2. | 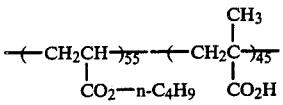 | −0.27° C. |
| 3. | 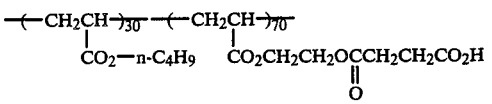 | |
| 4. | 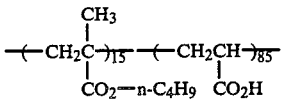 | 79.1° C. |
| 5. | 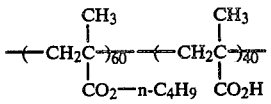 | 60° C. |
| 6. | 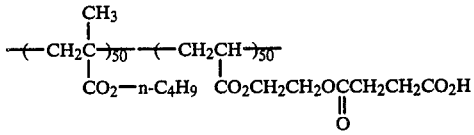 | |
| 7. | 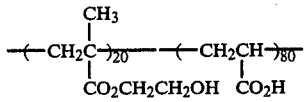 | 81.7° C. |
| 8. | 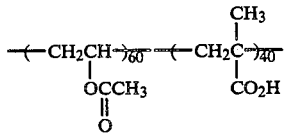 | 89° C. |
| 9. | 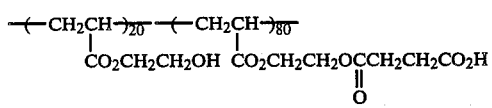 | |

These copolymers represented by formula (I) can be prepared according to the methods described in Japanese Patent Application No. 71,537/84.

The following synthesis example is incorporated from Japanese Patent Application No. 71,537/84:

SYNTHESIS EXAMPLES OF POLY-ACRYLIC ACID-CO-BUTYL METHACRYLATE

Into a one-liter three-necked flask equipped with a stirrer, a condenser, a dropping funnel, a mercury thermometer, and a nitrogen-introducing tube, 450 ml of ethanol and 30 ml of distilled water were charged, and the mixture was heated on a water bath. When the internal temperature of the flask had reached 70° C. and become stable, 0.4 g of 2,2'-azobis(2-amidinopropane)-hydrochloride as a polymerization initiator was added, and a previously prepared mixture of 184 g of an acrylic acid monomer and 64 g of an n-butyl methacrylate monomer was then gradually added dropwise from the dropping funnel over 3 hours. At this time, 0.4 g of the above-described polymerization initiator was added twice every hour. After completion of the dropwise addition, 0.4 g of the above-described polymerization initiator was further added four times every hour, and polymerization was carried out under stirring at 70° C. for 5 hours.

After completion of the heating and stirring, the internal temperature of the flask was reduced to room temperature, and the contents were then taken out. Yield: 645 g solids concentration of polymer: 40%, viscosity: 50 cp (as measured in a 20% ethanol solution thereof at 25° C. using an E-type viscometer).

The stripping layer in this invention is at least partially crosslinked by using a crosslinking agent. Method for performing the crosslinkage includes (1) a method of crosslinking the copolymer by a polyfunctional crosslinking agent capable of reacting with a carboxylic acid or a salt thereof, (2) a method of introducing other reactive monomer having an amino group, a hydroxy group, or an active methylene group into the copolymer as a copolymerizing component and crosslinking the copolymer by a crosslinking agent, and (3) a method of mixing the copolymer with a diamine compound or a polyamine compound and crosslinking the copolymer mixture with a carboxylic acid by a crosslinking agent.

The crosslinking agent for use in the above method can be selected from the various compounds described in *Research Disclosure,* No. 17643, page 26, 1978, December and *Product Licensing Index,* Vol. 92, No. 9232, 108(1972, December).

Examples of the particularly preferred crosslinking agents are an isocyanate compound having at least two isocyanate groups, an epoxy compound having at least two epoxy groups, and an ethyleneimine compound having at least two ethyleneimino groups and among these compounds, the above-described isocyanate compound is preferred. Specific examples of such crosslinking agents are illustrated below.

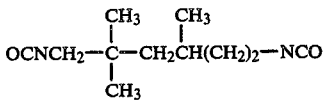

(A)

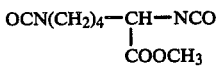

(B)

-continued $$OCN-(CH_2)_6-NCO \quad (C)$$

(D)

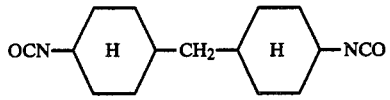

(E)

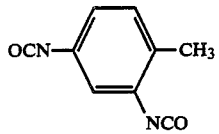

(F)

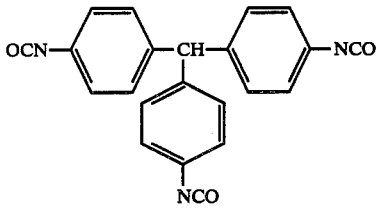

(G)

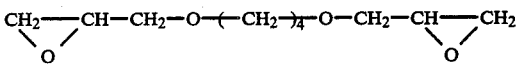

(H)

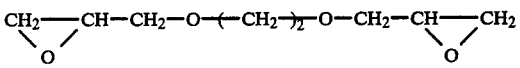

(I)

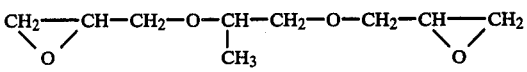

(J)

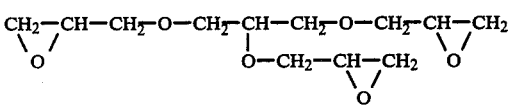

(K)

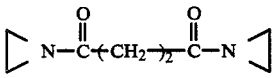

The crosslinking agent is preferably used in an amount of from 0.1 to 20% by weight, and more preferably 0.5 to 10% by weight, with respect to the amount of the copolymer represented by formula (I).

For forming the stripping layer for use in this invention, the copolymer of formula (I) and the crosslinking agent as described above are dissolved in an organic solvent such as acetone, methyl ethyl ketone, an alcohol (e.g., diacetone alcohol, isopropanol, methanol, ethanol, etc.,), dioxane, acetonitrile, tetrahydrofuran, formamide, ethyl acetate, etc., or a mixture of such organic solvents or a mixture of the organic solvent and water and the solution thus formed may be coating on a support by an ordinary coating method.

The support constituting the image-receiving element of this invention may be a hard material such as a glass sheet or porcelain or a flexible material such as a paper and a plastic film. In any case, it is important to select a support material which does not undergo severe dimensional change during storage or processing.

The support for use in this invention may be transparent or opaque and examples of such support are polyester films, polycarbonate films, polystyrene films, cellulose derivative films, papers, baryta-coated papers, papers coated with a pigment such as titanium white, and papers laminated with a polymer such as polyethylene, polystyrene, a cellulose derivative, etc.

Generally, the image-receiving element of this invention has a sheet-form support composed of such a flexible material, and hence the image-receiving element of this invention will further be explained below by referring to such an image-receiving sheet.

A preferred embodiment of the image-receiving layer of the image-receiving sheet of this invention is a layer containing a material, referred to as silver precipitating nuclear material or development center, which becomes a catalyst for the reduction of a water-soluble silver complex in a silver salt diffusion transfer process in a matrix material which is permeable to an alkaline processing composition or in a mordant layer for fixing diffusible dyes or dye compounds in a color diffusion transfer process.

Examples of silver precipitating nuclear materials include metals such as zinc, mercury, lead, cadmium, iron, chromium, nickel, tin, cobalt, copper, etc.; noble metals such as palladium, platinum, silver, gold, etc.; and the sulfides, selenides, tellurides, etc., of these metals. These silver precipitating nuclear materials can be prepared by reducing a corresponding metal ion to form a metal colloid dispersion or by mixing a metal ion solution and a solution of a soluble sulfide, senenide or telluride to form a colloid dispersion of the metal sulfide, the metal selenide or the metal telluride.

For obtaining the image-receiving element capable of providing images having a preferred tone, the silver precipitating nuclear material is usually present in the image-receiving layer in an amount of from $10^{-10}$ to $10^{-5}$ g/cm$^2$, and preferably from $10^{-8}$ to $10^{-6}$ g/cm$^2$.

Examples of the matrix material described above include hydrophilic binders such as gelatin, polyvinyl alcohol, carboxymethyl cellulose, methyl cellulose, etc., but in particular, an alkali-impermeable polymer rendered alkali-permeable by hydrolysis is preferably used.

Examples of alkali-impermeable polymer which can be hydrolyzed, there are cellulose esters such as cellulose triacetate, cellulose diacetate, cellulose propionate, cellulose acetate butyrate, etc., and polyvinyl esters such as polyvinyl acetate, polyvinyl propionate, polyvinyl chloroacetate, etc. An alkali-impermeable polymer layer composed of at least one of these polymers is rendered alkali permeable by hydrolysis with an alkali solution.

Other examples of the alkali-impermeable polymer are polyvinyl acetals such as polyvinyl formal, polyvinyl acetal, polyvinyl butyral, etc., and in this case, the polymer can be rendered alkali permeable by an acid hydrolysis.

For rendering the alkali-impermeable polymer layer alkali permeable by an alkali hydrolysis, a saponifying solution is prepared by dissolving an alkali such as sodium hydroxide, potassium hydroxide, lithium hydroxide, tetraalkyl ammonium hydroxide, etc., in an aqueous alcohol solution containing an alcohol such as methanol or ethanol at a concentration of 10 to 90% and the alkali-impermeable polymer layer is brought into contact with the saponifying solution by a conventionally known contact means such as brush coating, roller coating, aire knife coating, spray coating, immersion in the saponifying solution, etc. The surface of the alkali-impermeable polymer layer is saponified by the contact with the saponifying solution.

The layer this saponified becomes alkali permeable and a processing solution for a diffusion transfer process can permeate therethrough.

For forming the image-receiving layer for silver salt diffusion transfer process of this invention, methods that can be used include: incorporating a silver precipitating nucleus in a cellulose ester by vapor deposition, coating the cellulose ester on a support, and then alkali-hydrolyzing the coated layer; reacting, for example silver nitrate and sodium sulfite in a cellulose ester solution to form a silver precipitating nucleus in the solution, coating the cellulose ester solution on a support, and alkali-hydrolyzing the coated layer; a method of alkali-hydrolyzing a cellulose ester layer coated on a support and at the same time giving a silver precipitating nucleus in the hydrolyzed layer; and a method of alkali-hydrolyzing a cellulose ester layer to form a regenerated cellulose ester layer and then reacting, for example, chloroauric acid and a reducing agent in the hydrolyzed layer to form therein a silver precipitating nucleus.

For a neutralizing layer which can be used for the image-receiving sheet of this invention, a film-forming acid polymer is preferably used. Examples of the acid polymer include a copolymer of maleic anhydride (e.g., a styrene-maleic anhdride copolymer, a methyl vinyl ether-maleic anhydride copolymer, an ethylene-maleic anhydride copolymer, etc.,), a monobutyl ester of a copolymer of maleic anhydride and ethylene, a monobutyl ester of a copolymer of maleic anhydride and methyl vinyl ether, a monoethyl ester, monopropyl ester, monopentyl ester or monohexyl ester of a copolymer of maleic anhdride and ethylene, a monoethyl ester, monopropyl ester, monobenzyl ester or monohexyl ester of a copolymer of maleic anhydride and methyl vinyl ether, polyacrylic acid, polymethacrylic acid, a copolymer of acrylic acid and methyacrylic acid at various ratios, and a copolymer of acrylic acid or methacrylic acid and other vinyl monomer such as an acrylic acid ester (e.g., butyl acrylate, etc.,), a methacrylic acid ester, a vinyl ether, acrylamide, methacrylamide, etc., at various ratios, preferably from 50 to 90 mole% in the content of acrylic acid or methacrylic acid. Among these acid polymers, the use of polyacrylic acid or an acrylic acid-butyl acrylate copolymer is preferred in this invention. In addition, the above-described polymers may be used individually or as a mixture of them. Also, for improving the film strength, the above-described acid polymer may be used together with a cellulose derivative such as acetyl cellulose, etc.

For a neutralization timing layer, for example, gelatin, polyvinyl alcohol, polyacrylamide, partially hydrolyzed polyvinyl acetate, a copolymer of $\beta$-hydroxyethyl methacrylate and ethyl acrylate, or acetyl cellulose is used as the main component. Other examples of the compounds for the neutralization timing layer are described in U.S. Pat. Nos. 3,455,686; 3,421,893; 3,785,815; 3,847,615; 4,009,030; Japanese Patent Application (OPI) No. 14,415/77, etc. Furthermore, the polymer layer having a large temperature dependence about the permeability for an alkaline processing solution as described in, for example, U.S. Pat. Nos. 4,056,394; 4,061,496; Japanese Patent Application (OPI) Nos. 72,622/78 and 78,130/79 may be used together with the above-described neutralization timing layer in this invention.

Furthermore, a polymerization product of a monomer which causes elimination in an alkaline atmosphere can be also utilized for the neutralization timing layer.

In an embodiment of the image-receiving sheet for silver salt diffusion transfer process of this invention, the portion of the cellulose ester layer containing acetyl cellulose, which was not hydrolyzed, may contain one kind or more mercapto compounds suitable for improving the photographic properties of the transferred silver images such as color tone, the stabilization, etc. Such a mercapto compound is utilized by being diffused from the initially disposed position during inhibition. An image-receiving element of this type is described in U.S. Pat. No. 3,607,269 (Richard W. Young) and Japanese Patent Application No. 148,979/83.

Also, if necessary, other hydrophilic polymer layer may be formed between the hydrolyzed cellulose ester layer containing a silver precipitating nucleus and a cellulose ester layer or a partially hydrolyzed cellulose ester layer (which may contain the above-described mercapto compound) which is disposed under the foregoing hydrolyzed cellulose ester layer. Examples of the polymer which is used for the hydrophilic polymer layer are gelatin, a gelatin derivative (e.g., phthalated gelatin, etc.,), saccharides (e.g., starch, galactomannan, gum arabic, hydroxyethyl cellulose, carboxymethyl cellulose, methyl cellulose, pullulan, hydroxypropyl cellulose, etc.,), a hydrophilic synthetic polymer (e.g., polyacrylamide, polymethylacrylamide, poly-N-vinylpyrrolidone, 2-hydroxyethyl methacrylate, etc.,), etc.

As a mordant layer for color diffusion transfer process, a hydrophilic colloid layer containing a polymer mordant is preferred.

Examples of the proper polymer mordant include a polymer containing a secondary or tertiary amino group, a polymer having a nitrogen-containing heterocyclic moiety, a polymer having a quaternary cation group, etc., each having a molecular weight of from about 5,000 to 200,000, and preferably from 10,000 to 50,000.

Specific examples of the polymer mordant include vinylpyridine polymers and vinylpyridium cation polymers described in U.S. Pat. Nos. 2,548,564, 2,484,430, 3,148,061, 3,756,814, etc.; the imidazole series polymers described in Japanese Patent Application (OPI) Nos. 48,210/80 and 129,346/80 and U.S. Pat. Nos. 4,282,305, 4,273,853, 4,193,796, 4,228,257, 4,229,515, etc.; the polymer mordants which are crosslinkable with gelatin described in U.S. Pat. Nos. 3,625,694, 3,859,096, 4,128,538, etc.; the latex-type mordants or aqueous sol-type modants disclosed in U.S. Pat. Nos. 3,958,995, 2,721,852, and 2,798,063, Japenese Patent Application (OPI) Nos. 115,228/79, 145,529/79, and 126,027/79; Japanese Patent Application (OPI) No. 232340/84, etc.; the water-insoluble mordants disclosed in U.S. Pat. No. 3,898,088; the reactive mordants capable of performing covalent bonding with dyes disclosed in U.S. Pat. No. 4,168,976; and the mordants disclosed in U.S. Pat. Nos. 3,709,690, 3,788,855, 3,642,482, 3,488,706, 3,557,066, 3,271,147, and 3,271,148, and Japanese Patent Application (OPI) Nos. 71,332/75, 30,328/78, 155,528/77, 125/78, and 1024/78.

Still further, the mordants described in U.S. Pat. No. 2,675,316 can be used in this invention.

In the above-described mordants, mordants which are resistant to transfer from the mordant layer into other layer(s) are preferred. For example, a mordant capable of causing a crosslinking reaction with a matrix such as gelatin, etc., a water-insoluble mordant, are a latex dispersion-type (or aqueous sol-type) mordant can be preferably used.

The image-receiving sheet of this invention may further have a light-sensitive layer or light-sensitive layers on the same support, but it is preferred that the image-receiving element does not have light-sensitive layer(s) on the same support. That is, it is preferred that the light-sensitive layer(s) are formed on a support other than the support used for the image-receiving element to provide a light-sensitive sheet or element and in this case, an embodiment of a photographic film unit having a pressure-rupturable container containing a processing solution disposed between the image-receiving sheet and the light-sensitive sheet is preferred.

The light-sensitive layers are preferably composed of a silver halide emulsion and the emulsion may be a so-called surface latent image-type emulsion or an internal latent image-type emulsion. When the coloring materials which are used in combination with the light-sensitive layer(s) are couplers or redox compounds of the type releasing a diffusible dye (or a precursor thereof) by causing a reaction with an oxidizing agent, the use of an internal latent image-type direct positive silver halide emulsion is preferred.

As a hardening agent for silver halide emulsions, the vinylsulfone compounds described in Japanese Patent Application (OPI) No. 41,221/78 are preferably used.

Examples of the redox compound (DRR compounds) capable of releasing imagewise a diffusible dye as the result of development, which can be used in the combination with the light-sensitive layer(s), are described in U.S. Pat. Nos. 3,928,312, 3,993,638, 4,076,529, 4,152,153, 4,055,428, 4,053,312, 4,198,235, 4,179,291, 4,149,892, 3,844,785, 3,443,043, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,278,750, 4,135,929, 4,336,322, 4,371,604, and 4,139,389; Japanese Patent Application (OPI) Nos. 50,736/78, 4819/77, 104,343/76, 130,122/79, 110,827/78, 12,642/81, 16,131/81, 4043/82, 650/82, 20,735/82, 69,033/78, 130,927/79, 164,342/81, 119,345/82, etc.

Furthermore, dye developing agents which are diffusible in an alkaline processing solution but become non-diffusible (immobile) by being oxidized as the result of development can be used as the coloring materials.

These coloring materials may exist in the light-sensitive layers or may exist in a layer in contact with the light-sensitive layer directly or through a third layer.

In a color diffusion transfer process using DRR compounds, any silver halide developing agents which can cross-oxidize the DRR compounds can be used, but the use of a black and white developing agent (in particular, pyrazolidinones) is preferred from the view point of causing less formation of stain.

The neutralizing layer, the neutralization timing layer, the hydrophilic polymer layer, the image-receiving layer and/or the stripping layer in this invention may contain various additives. As such additives, there are optical whitening agents, light-scattering agents for preventing the occurrence of light piping (e.g., titanium dioxide, carbon black, etc.,), plasticizers (e.g., tricresyl phosphate, dibutyl phthalate, etc.,), wetting agents (e.g., trimethylolpropane, glycerol, etc.,), matting agents (e.g., silica, titanium dioxide, crosslinked polymethyl methacrylate particles, etc.,), surface active agents, perfumes, etc.

In a light-sensitive sheet which is used in a combination with the image-receiving sheet of this invention, a protective layer composed of a vehicle such as gelatin, etc., can be formed on the silver halide emulsion layer thereof. The protective layer may contain a matting agent for matting the surface. As the matting agent, a latex polymer such as polymethyl methacrylate, etc., or an inorganic material such as silica, etc., can be preferably used. Furthermore, for the purposes of prevention of the formation of scratches or imparting slidability, a higher fatty acid or a silicone compound may be added to the protective layer.

The processing composition for use in this invention contains a base such as sodium hydroxide, potassium hydroxide, sodium carbonate, sodium phosphate, etc., and has a pH of higher than 9, preferably higher than 11.5. The processing composition may further contain an antioxidant such as sodium sulfite, an ascorbate, pyridinohexose reductone, etc., and a silver ion concentration controlling agent such as potassium bromide, etc. Furthermore, the processing composition may contain a viscosity increasing compound such as hydroxyethyl cellulose, sodium carboxymethyl cellulose, etc.

In the case of using the image-receiving sheet of this invention for a silver salt diffusion transfer process, a hydroxyamine series silver halide developing agent is particularly useful for forming transferred silver images without or almost without need of post processing in the case of using it in a combination with a silver image-receiving layer of regenerated cellulose. Particularly preferred hydroxylamine series silver halide developing agents are N-alkyl-substituted hydroxylamines and N-alkoxyalkyl-substituted hydroxylamines. Many such hydroxyamines are described in U.S. Pat. Nos. 2,857,274, 2,857,275, 2,857,276, 3,287,124, 3,287,125, 3,293,034, 3,362,961, and 3,740,221. Particularly useful hydroxylamine series silver halide developing agents are N,N-diethyl-hydroxylamine, N,N-bis-methoxyethylhydroxylamine, and N,N-bis-ethoxyethylhydroxylamine.

Also, as a silver halide solvent, a thiosulfate of an alkali metal (e.g., sodium thiosulfate or potassium thiosulfate) may be used, but the cyclic imides such as uracil, urazol, 5-methyl-uracil, 6-methyl-uracil, etc., described in U.S. Pat. Nos. 3,857,274, 3,857,275, and 3,857,276 are preferred.

The following examples are intended to illustrate this invention, but not to limit it in any way.

EXAMPLE 1

A solution of 18 g of cellulose acetate (acetylation degree of 53%) and 12 g of a methylvinyl ether-maleic anhydride copolymer dissolved in a mixture of 270 ml of acetone and 30 ml of methanol was coated on a polyethylene-coated paper at a coverage (thickness) of 70 ml/m$^2$ and dried. Then, an acetone solution of cellulose acetate containing 0.12% 1-(4-hexylcarbamoylphenyl)-2,3-dihydroimidazole-2-thion was coated on the coated layer at a dry thickness of 50 mg/dm$^2$. Furthermore, a solution of an aqueous solution of 5% polyacrylamide containing 1 ml of formalin was coated on the layer at a dry thickness of 2 g/m$^2$ and dried and further an acetone solution of cellulose acetate was also coated on a dry thickness of 0.01 g/dm$^2$ and dried. Then, an alkali solution containing nickel sulfide having the composition shown below was coated on the aforesaid layer at a thickness of 20 ml/m$^2$ followed by drying and then washed with water and dried. Still further, a mixed solvent of methanol and acetone (1/1) containing $1\times10^{-3}$% by weight 2-mercaptobenzimidazole, 0.2% by weight of a copolymer of butyl methacrylate and acrylic acid (15/85 by mole ratio) according to this invention, and 0.004% by weight 2,2,5-trimethylhexylene-1,6-diisocyanate (Compound A illustrated above as cross-linking agent) was coated thereon at a coverage of 16 g/m$^2$ and dried to provide image-receiving sheet 1-1 of this invention.

The alkali solution used in the above coating step was as follows.

Sodium Hydroxide: 20 g
Water: 200 ml
Methanol: 800 ml
Glycerol: 30 g
Nickel Sulfide (NiS): 0.06 g Nickel sulfide contained in the above-described alkali solution was prepared by reacting an aqueous solution of 20% nickel nitrate and an aqueous solution of 20% sodium sulfite in glycerol while stirring well.

EXAMPLE 2

A solution of 18 g of cellulose acetate (acetylation degree of 54%) and 12 g of a styrene-maleic anhydride copolymer dissolved in a mixture of 270 ml of acetone and 30 ml of methanol was coated on a polyethylene-coated paper at a thickness of 54 ml/m$^2$ and dried. Then, an acetone solution of cellulose acetate containing 0.10% 1-(4-N-hexylcarbamoylphenyl)-2,3-dihydroimidazole-2-thion was coated on the layer at a dry thickness of 6.5 g/m$^2$. Furthermore, to an aqueous 5% polyacrylamide solution were added an aqueous 5% dimethylolurea and acetic acid (50%) at the concentrations of 5% and 1.25%, respectively, and the solution thus obtained was coated on the layer at a thickness of 25 ml/m$^2$. Furthermore, an acetone-methanol solution of cellulose acetate having finely dispersed therein palladium sulfide was coated thereon. The coating solution contained 1-phenyl-5-mercaptoimidazole at a coating amount of $25\times10^{-6}$ mole/m$^2$. The dry thickness of the coated layer was 0.8 μm. Then, the alkali solution having the composition shown below was coated on the coated layer at a coverage of 18 ml/m$^2$, washed with water, and dried.

Potassium hydroxide (86%): 25 g
Methanol: 400 ml
Water: 100 ml

Thereafter, a methanol-acetone mixed solvent containing 0.2% by weight a copolymer of butyl methacrylate and acrylic acid (15/85 by mole ratio) according to this invention and 0.005% by weight tolylene diisocyanate (Compound E illustrate above as the crosslinking agent in this invention) was coated on the layer at a coverage of 15.8 g/m$^2$ and dried.

Then, the following layers were coated, in succession, on the above-described polyethylene-coated paper at the surface opposite to the surface coated with the above-described layers to provide image-receiving sheet 1-2.

(Light-Shielding Layer) containing 8.0 g/m$^2$ of carbon black, 4.0 g/m$^2$ of gelatin, 0.02 g/m$^2$ of formaldehyde, and 2.0 g/m$^2$ of trimethylolpropane.

(White Layer) containing 10.0 g/m$^2$ of titanium dioxide, 1.5 g/m$^2$ of gelatin, and 0.45 g/m$^2$ trimethylolpropane.

(Protective Layer) containing 0.5 g/m$^2$ of gelatin, 0.3 g/m$^2$ of granular polymethyl methacrylate, and 0.02 g/m$^2$ of formaldehyde.

In addition, the palladium sulfide dispersion described above was prepared by adding a methanol solution of $7\times10^{-3}$ mole sodium sulfide and a methanol solution of $7\times10^{-3}$ mole sodium palladium chloride to an acetonemethanol mixed solution of 5.3% cellulose acetate while stirring well.

EXAMPLE 3

By following the same procedure as Example 1 except that a copolymer of butyl methacrylate and acrylic acid (10/90 by mole ratio) was used in place of the copolymer of butyl methacrylate and acrylic acid (15/85 by mole ratio) in Example 1, image-receiving sheet 1-3 was prepared.

EXAMPLE 4

By following the same procedure as Example 2 except that a copolymer of butyl methacrylate and acrylic acid (10/90 by mole ratio) was used in place of the copolymer of butyl methacrylate and acrylic acid (15/85 by mole ratio) in Example 2, image-receiving sheet 1-4 was prepared.

EXAMPLE 5

By following the same procedure as Example 2 except that the above-illustrated crosslinking agent, Compound G was used in place of tolylene diisocyanate in Example 2, image-receiving sheet 1-5 was prepared.

EXAMPLE 6

By following the same procedure as Example 2 except that the above-illustrated crosslinking agent, Compound J was used in place of tolylene diisocyanate in Example 2, image-receiving sheet 1-6 was prepared.

COMPARISON EXAMPLE 1

By following the same procedure as Example 2 except that gum arabic (0.2% aqueous solution) was used in place of the solution containing 0.2% by weight copolymer of butyl methacrylate and acrylic acid (15/85 by mole ratio) and 0.005% by weight tolylene diisocyanate used in Example 2, comparison image-receiving sheet 2-1 was prepared.

COMPARISON EXAMPLE 2

By following the same procedure as Example 2 except that a methanol-acetone mixed solution containing 0.2% by weight copolymer of butyl methacrylate and acrylic acid (15/85 by mole ratio) but not containing tolylene diisocyanate was used in place of the methanol-acetone mixed solution containing 0.2% by weight copolymer of butyl methacrylate and acrylic acid (15/85 by mole ratio) and 0.005% by weight tolylene diisocyanate used in Example 2, comparison image-receiving sheet 2-2 was prepared.

Then, each of the image receiving sheets 1-1 to 1-5 prepared in the above examples and comparison image-receiving sheets 2-1 and 2-2 prepared in the above comparison examples was subjected to a diffusion transfer development processing using the following light-sensitive layer sheet and processing solution to provide positive images.

(1) Preparation of light-sensitive layer sheet

Silver iodobromide having a mean grain size of 1.0 μm was prepared by a conventional method. The silver halide was placed in a 100 gram pot and heated in a bath maintained at 50° C. To the silver halide were added 10 ml of an aqueous 1 weight % solution of 3-{5-chloro-2-[2-ethyl-3-(3-ethyl-2-benzothiazolinidene)propenyl]-3-benzoxazolio}propane sulfonate, 4-{2-[3-ethylbenzothiazolin-2-ylidene)-2-methyl-1-propenyl]-3-benzothiazolio}propane sulfonate, and 4-hydroxy-6-methyl-1,3,3a,7-tetraazaindene, 10 ml of an aqueous 1 weight % solution of 2-hydroxy-4,6-dichlorotriazine sodium salt, and further 10 ml of an aqueous 1 weight % solution of sodium dodecylbenzenesulfonate followed by stirring.

The silver halide emulsion thus prepared was coated on a polyethylene terephthalate film base having a subbing layer containing titanium oxide at a dry thickness of 5 μm and dried. The silver coverage of the coating was 1.0 g/m$^2$.

Then, the following back layers were coated on the film base at the opposite side to the emulsion-coated surface to provide a light-sensitive sheet sample.

(Light shielding layer) containing 3.0 g/m$^2$ of gelatin, 6.0 g/m$^2$ of carbon black and 0.3 g/m$^2$ of formaldehyde.

(Protective layer) containing 0.3 g/m$^2$ of gelatin and 0.5 g/m$^2$ of granular polymethyl methacrylate.

(2) Composition of processing solution

Potassium hydroxide (aqueous 40% solution): 323 ml
Titanium dioxide: 3 g
Hydroxyethyl cellulose: 79 g
Zinc oxide: 9.75 g
N,N-Bis-methoxyethylhydroxyamine: 75 g
Aqueous triethanolamine solution (4.5 parts of triethanolamine to 6.2 parts of water): 17.14 g
Tetrahydropyrimidinethion: 0.4 g
2,4-Dimercaptopyrimidine: 0.35 g
Uracil: 80 g
Water: 1193 g The light-sensitive layer sheet thus prepared was exposed through an optical wedge using an actinometer having a light source of a color temperature of 5,400° K. The exposed light-sensitive layer sheet was superposed on the above-described image-receiving layer sheet, the above-described processing solution was spread therebetween at a thickness of 0.035 mm to perform diffusion transfer development, and after allowing to stand for 10 minutes at 40° C., the image-receiving layer sheet was separated from the light-sensitive layer sheet at a relatively slow speed.

In this case, the area of the layer of the processing solution remained on the surface of each of the image-receiving sheets was 0 to 3% in samples 1-1 to 1-5 of this invention and about 100% and 15% in comparison samples 2-1 and 2-2, respectively.

When the image-receiving sheets were stored for 7 days at 60° C. and 70% in R.H. (relative humidity), the remaining portion of the processing solution layer was discolored.

From the above result, it can be seen that in the case of using the stripping layer of this invention, the attach of processing solution to the surface of the image-receiving sheet is less and stripping property is remarkably improved as compared to comparison image-receiving sheets.

Also, the positive prints obtained by separating the image-receiving sheets after allowing to stand for 90 seconds at 15° C. and images allowed to stand for one day at normal temperature and normal humidity showed no "clouding" in the samples of this invention.

EXAMPLE 7

An image-receiving sheet for color diffusion transfer process of this invention having the following construction was prepared.

Paper Support: Paper of 150 μm in thickness having polyethylene layer of 30 μm in thickness at both the surface thereof. The polyethylene layer at the image-receiving layer side contained titanium oxide in an amount of 10% to the weight of polyethylene.

Back Side:

(a) Light-shielding layer containing 4.0 g/m$^2$ of carbon black and 2.0 g/m$^2$ of gelatin.

(b) White layer containing 8.0 g/m$^2$ of titanium oxide and 1.0 g/m$^2$ of gelatin.

(c) Protective layer containing 0.6 g/m$^2$ of gelatin.

The layers (a) to (c) were formed in this order.

Image-receiving Layer Side:

(1) Neutralizing layer containing 22 g/m$^2$ of a copolymer of acrylic acid and butyl acrylate (8/2 by mole ratio) having a mean molecular weight of 50,000.

(2) Neutralization timing layer containing 4.5 g/m$^2$ of a mixture of cellulose acetate having an acetylation degree of 51.3% (i.e., the amount of acetic acid released by hydrolysis is 0.513 g per gram of the cellulose acetate) and a copolymer of styrene and maleic anhydride (1/1 by mole ratio) having a mean molecular weight of about 10,000 in a ratio of 95/5 by weight ratio.

(3) Layer containing a blend (at 1.6 g/m$^2$ in total solid components) of a polymer latex prepared by emulsion polymerizing styrene, butyl acrylate, acrylic acid, and N-methylolacrylamide at a ratio of 49.7/42.3/4/4 by weight ratio and a polymer latex prepared by emulsion polymerizing methyl methacrylate, acrylic acid, and N-methylolacrylamide at 93/3/4 by weight ratio in 6/4 by solids content ratio.

(4) Image-receiving layer containing 3.0 g/m$^2$ of the polymer having the following formula and 3.0 g/m$^2$ of gelatin.

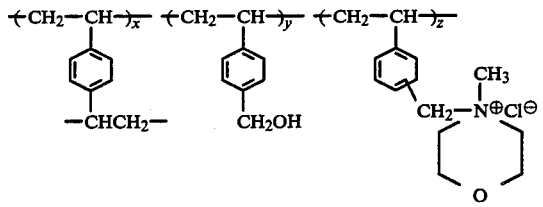

x/y/z = 5/5/90

(5) Layer containing 0.1 g/m$^2$ of a copolymer of butyl methacrylate and acrylic acid (1/9 by mole ratio) and 0.002 g/m$^2$ of 2,2,5-trimethylhexylene-1,6-diisocyanate.

Light-sensitive Sheet:

A light-sensitive sheet was prepared by coating the following layers of a polyethylene terephthalate transparent support.

Back Side:

(a) Light-shielding layer containing 4.0 g/m$^2$ of carbon black and 2.0 g/m$^2$ of gelatin.

Emulsion Layer Side:

(1) Layer containing 0.44 g/m$^2$ of the cyan dye-releasing redox compound having the formula shown below, 0.09 g/m$^2$ of tricyclohexyl phosphate, 0.008 g/m$^2$ of 2,5-di-t-pentadecylhydroquinone, and 0.8 g/m$^2$ of gelatin.

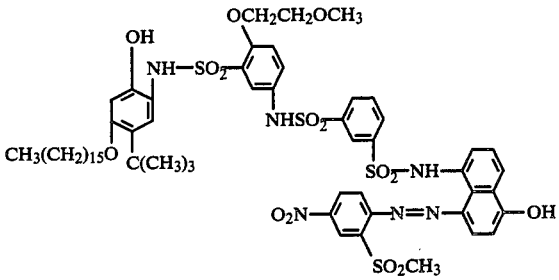

(2) Red-sensitive emulsion layer containing a red-sensitive internal latent image-type direct positive silver bromide emulsion (1.03 g/m$^2$ as silver coverage), 1.2 g/m$^2$ of gelatin, 0.13 g/m$^2$ of 2-sulfo-5-n-pentadecylhydroquinone.sodium salt, and 0.04 mg/m$^2$ of a nucleating agent having the following formula.

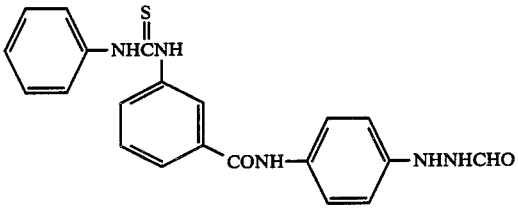

(3) Layer containing 0.43 g/m$^2$ of 2,5-di-t-pentadecylhydroquinone, 0.1 g/m$^2$ of trihexyl phosphate, and 0.4 g/m$^2$ of gelatin.

(4) Layer containing 0.21 g/m$^2$ of the magenta dye-releasing redox compound having structural formula I shown below, 0.11 g/m$^2$ of the magenta dye-releasing redox compound having structural formula II shown below, 0.08 g/m$^2$ of tricyclohexyl phosphate, 0.009 g/m$^2$ of 2,5-di-t-pentadecylhydroquinone, and 0.9 g/m$^2$ of gelatin.

Structural Formula I:

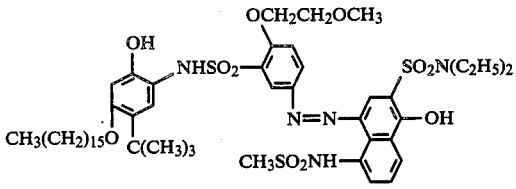

Structural Formula II:

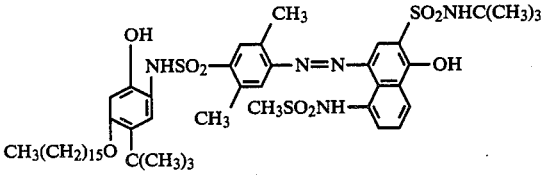

(5) Green-sensitive emulsion layer containing a green-sensitive internal latent image-type direct positive silver bromide emulsion (0.82 g/m$^2$ as silver coverage), 0.9 g/m$^2$ of gelatin, 0.03 mg/m$^2$ of the same nucleating agent used for layer (2), and 0.08 g/m$^2$ of 2-sulfo-5-n-pentadecylhydroquinone.sodium salt.

(6) Same as layer (3).

(7) Layer containing 0.53 g/m$^2$ of the yellow dye-releasing redox compound having the structural formula shown below, 0.13 g/m$^2$ of of tricyclohexyl phosphate, 0.014 g/m$^2$ of 2,5-di-t-pentadecylhydroquinone, and 0.7 g/m$^2$ of gelatin.

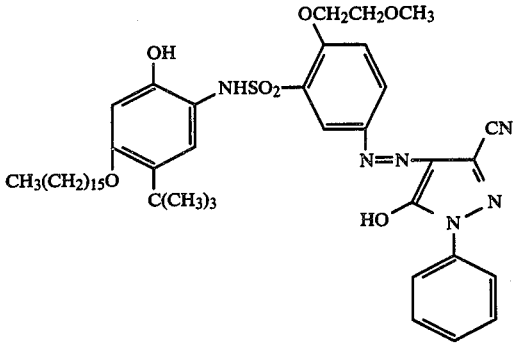

(8) Blue-sensitive emulsion layer containing a blue-sensitive internal latent image-type direct positive silver bromide emulsion (1.09 g/m$^2$ as silver coverage), 1.1 g/m$^2$ of gelatin, 0.04 mg/m$^2$ of the same nucleating agent as used for layer (2), and 0.07 g/m$^2$ of 2-sulfo-5-n-pentadecylhydroquinone.sodium salt.

(9) Layer containing 1.0 g/m$^2$ of gelatin.

The above-described light-sensitive sheet was placed on the above-described image-receiving sheet in the unexposed state and the processing solution having the composition shown below was spread between the sheets at a thickness of 65 $\mu$m by means of pressure-applying rollers.

Processing Solution 1-p-Tolyl-4-hydroxymethyl-4-methyl-3-pyrazolidone: 6.9 g
Methylhydroquinone: 0.3 g
5-Methylbenzotriazole: 3.5 g
Sodium Sulfite (Anhydrous): 0.2 g
Carboxymethyl cellulose.Na salt: 58 g
Potassium Hydroxide (Aqueous 28% Solution): 200 ml
Benzyl Alcohol: 1.5 ml
Water: 835 ml In this case, when the processing temperature was changed from 15° C. to 40° C. and the stripping time of the image-receiving sheet was changed from 60 seconds to 10 minutes, the processing solution did not remain on the surface of the image-receiving sheet in any case, and also no "clouding" was formed on the surface.

While the invention has been described in detail and with reference to specific embodiments thereof, it will be apparent to one skilled in the art that various changes and modification can be made therein without departing from the spirit and scope thereof.

What is claimed is:

1. A photographic film unit, comprising:

a light-sensitive element containing a first support having coated thereon at least one light-sensitive silver halide emulsion layer, and an image-receiving element comprising a second support having thereon at least one image-receiving layer and a stripping layer composed of a copolymer containing more than 40 mol percent of a monomer unit derived from an ethylenically unsaturated carboxylic acid or salt thereof which is at least partially crosslinked, wherein said stripping layer is positioned between the light-sensitive silver halide emulsion layer and the image-receiving layer.

2. A photographic film unit as in claim 1, wherein the copolymer is represented by the formula (I)

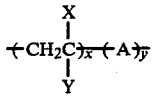

(I)

wherein X represents a hydrogen atom, a halogen atom, a cyano group, or an unsubstituted or substituted alkyl group; Y represents a hydrogen atom, a halogen atom, a cyano group, an unsubstituted or substituted alkyl group, a group represented by

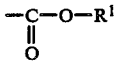

(wherein $R^1$ represents an unsubstituted or substituted alkyl group having 2 or more carbon atoms or an unsubstituted or substituted aryl group), a group represented by

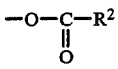

(wherein $R^2$ represents an unsubstituted or substituted alkyl group or an unsubstituted or substituted aryl group), a group represented by

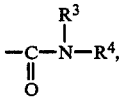

or a group represented by

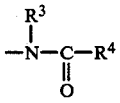

(wherein $R^3$ and $R^4$ each represents a hydrogen atom, an unsubstituted or substituted alkyl group, or an unsubstituted or substituted aryl group); A represents a monomer unit derived from an ethylenically unsaturated monocarboxylic acid which is copolymerizable with an ethylenically unsaturated monomer, or a salt of the monocarboxylic acid; and x and y are mol or percentages of the repeating units in the copolymer and have the relationship $$x+y=100,$$

$$0<x<60,$$

and $$40 \leqq Y<100.$$

3. A photographic film unit as in claim 2, wherein the component represented by A is derived from a monomer represented by the formula (II)

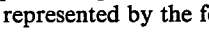

(II)

wherein $R^5$ represents a hydrogen atom, a group represented by

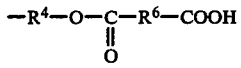

(wherein $R^4$ and $R^6$ each represents an unsubstituted or substituted alkylene group) or a group represented by

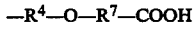

(wherein $R^4$ is the same as defined above and $R^7$ represents an unsubstituted or substituted alkylene group or an unsubstituted or substituted arylene group).

4. A photographic film unit as in claim 1, wherein the thickness of the stripping layer is from about 0.001 $g/m^2$ to 1.0 $g/m^2$.

5. A photographic film unit as in claim 2, wherein the thickness of the stripping layer is from about 0.001 $g/m^2$ to 1.0 $g/m^2$.

6. A photographic film unit as in claim 3, wherein the thickness of the stripping layer is from about 0.001 $g/m^2$ to 1.0 $g/m^2$.

7. A photographic film unit as in claim 1, wherein the thickness of the stripping layer is from about 0.01 $g/m^2$ to 0.5 $g/m^2$.

8. A photographic film unit as in claim 2, wherein the thickness of the stripping layer is from about 0.01 $g/m^2$ to 0.5 $g/m^2$.

9. A photographic film unit as in claim 3, wherein the thickness of the stripping layer is from about 0.01 $g/m^2$ to 0.5 $g/m^2$.

10. A photographic film unit as in claim 2, wherein X is a hydrogen atom or an unsubstituted or substituted alkyl group, said alkyl residue having from 1 to 4 carbon atoms, Y is a group represented by

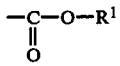

(wherein $R^1$ is an unsubstituted or substituted alkyl group, said alkyl residue having from 2 to 12 carbon atoms), a group represented by

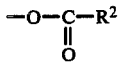

(wherein $R^2$ is an unsubstituted or substituted alkyl group, said alkyl residue having from 1 to 12 carbon atoms), or a group represented by

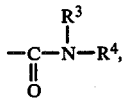

or

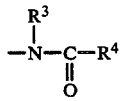

(wherein $R^3$ and $R^4$ each represents a hydrogen atom or an unsubstituted or substituted alkyl group, said alkyl residue having from 1 to 12 carbon atoms); and y is from 60 to 99.

11. A photographic film unit as in claim 10, wherein y is from 70 to 90.

12. A photographic film unit as in claim 10, wherein Y is a group represented by $$-\underset{\underset{O}{\|}}{C}-O-R^1$$

(wherein $R^1$ is an unsubstituted or substituted alkyl group, said alkyl residue having from 2 to 6 carbon atoms) or a group represented by $$-O-\underset{\underset{O}{\|}}{C}-R^2$$

(wherein $R^2$ is an unsubstituted or substituted alkyl group, said alkyl residue having from 1 to 6 carbon atoms).

13. A photographic film unit as in claim 1, wherein said stripping layer is at least partially crosslinked using a crosslinking agent selected from the group consisting of an isocyanate compound having at least two isocyanate groups, an epoxy compound having at least two epoxy groups, and an ethyleneimine compound having at least two ethyleneimino groups.

14. A photographic film unit as in claim 13, wherein said crosslinking agent is an isocyanate compound having at least two isocyanate groups.

15. A photographic film unit as in claim 2, wherein said stripping layer is at least partially crosslinked using a crosslinking agent selected from the group consisting of an isocyanate compound having at least two isocyanate groups, an epoxy compound having at least two epoxy groups, and an ethyleneimine compound having at least two ethyleneimino groups in an amount of from 0.1 to 20 percent by weight with respect to the amount of the copolymer represented by formula (I).

16. A photographic film unit as in claim 15, wherein said crosslinking agent is used in an amount of from 0.5 to 10% by weight with respect to the amount of the copolymer represented by formula (I).

17. A photographic film unit in claim 2, wherein said stripping layer is at least partially crosslinked using an crosslinking agent which is an isocyanate compound having at least two isocyabate groups in an amount from 0.1 to 20 percent by weight with respect to the amount of the copolymer represented by formula (I).

18. A photographic film unit as in claim 17, wherein said crosslinking agent is used in an amount of from 0.5 to 10% by weight with respect to the amount of the copolymer represented by formula (I).

19. An image-receiving element for a diffusion transfer photographic process comprising a support having thereon an image-receiving layer and a stripping layer as the outermost layer on the side of the support which contains the image-receiving layer composed of a copolymer containing more than 40 mol percent of a monomer unit derived from an ethylenically unsaturated carboxylic acid or salt thereof which is at least partially crosslinked.

20. A photographic film unit, comprising:

a light-sensitive element containing a first support having coated thereon at least one light-sensitive silver halide emulsion layer, an image-receiving element containing on a second support at least one image-receiving layer, and a pressure-rupturable container containing a processing solution between the elements, wherein said image-receiving element contains a stripping layer composed of a copolymer containing more than 40 mol percent of a monomer unit derived from an ethylenically unsaturated carboxylic acid or a salt thereof which is at least partially crosslinked, and said stripping layer is contained between the light-sensitive silver halide emulsion layer and the image-receiving layer.

21. A photographic film unit as in claim 1, wherein said stripping layer is the outermost layer of the image-receiving element on the side of the second support which contains the image-receiving layer.

* * * * *